US005419496A

United States Patent [19]

Novak, Jr.

[11] Patent Number: 5,419,496

[45] Date of Patent: May 30, 1995

[54] WATER WAND APPARATUS

[76] Inventor: Robert F. Novak, Jr., 8 Franklin Ave., Clinton, N.Y. 13323

[21] Appl. No.: 214,114

[22] Filed: Mar. 17, 1994

[51] Int. Cl.[6] ..... B05B 1/02; B05B 13/06

[52] U.S. Cl. ..... 239/530; 239/532; 239/562; 239/DIG. 13

[58] Field of Search ..... 230/530, 532, 548, 562, 230/DIG. 13; 134/167 C, 167 R

[56] References Cited

U.S. PATENT DOCUMENTS

| | | | |
|---|---|---|---|
| D. 300,453 | 3/1989 | Proctor et al. . | |
| 691,651 | 1/1902 | Morrill | 239/532 X |
| 1,444,889 | 2/1923 | Sladden | 239/548 X |
| 2,910,711 | 11/1959 | Mizelle | 239/532 X |
| 3,104,672 | 9/1963 | Holdren | 239/DIG. 13 X |
| 4,206,313 | 6/1980 | Cavoretto | 134/167 C |
| 4,302,040 | 11/1981 | Lazar | 239/548 X |
| 4,699,163 | 10/1987 | Baziuk | 134/167 C |
| 4,756,324 | 7/1988 | Larsson | 239/DIG. 13 X |
| 4,850,728 | 7/1989 | Arroyd . | |
| 4,930,706 | 6/1990 | Merlin . | |
| 5,022,586 | 6/1991 | Putnam . | |
| 5,058,612 | 10/1991 | Winsted . | |

FOREIGN PATENT DOCUMENTS

| | | | |
|---|---|---|---|
| 753996 | 10/1933 | France | 239/548 |

*Primary Examiner*—William Grant

[57] ABSTRACT

A new and improved water wand apparatus includes a handle assembly which includes a tubular member which is adapted for conducting water flow in a first direction from a source end to a nozzle end in the tubular member. A nozzle assembly is connected to the tubular member and includes a nozzle-containing wall which includes a connection aperture for connecting to the tubular member. The nozzle-containing wall also includes a plurality of nozzle channels. The nozzle assembly also includes a truncated conical wall assembly connected to the nozzle-containing wall. An apex wall assembly is connected to a narrow end of the truncated conical wall assembly and serves to block water flow in the first direction causing pressurized water to exit from the nozzle channels in a second direction. The tubular member is substantially straight, and the tubular member and the nozzle assembly 16 are symmetrically disposed around a longitudinal axis. The nozzle-containing wall is perpendicular to the longitudinal axis. The nozzle channels are arrayed in a circular pattern on the nozzle-containing wall symmetrically around the longitudinal axis. The nozzle channels are oriented in the nozzle-containing wall in a range of spray angles ranging from 0 to 60 degrees with respect to the longitudinal axis. A manually-operated valve assembly is connected to the tubular member for controlling water flow through the manually-operated valve assembly, the tubular member, the nozzle assembly, and out the nozzle channels.

5 Claims, 1 Drawing Sheet

WATER WAND APPARATUS

BACKGROUND OF THE INVENTION

1. Field of the Invention

The present invention relates generally to devices for controlling the flow of water from a hose and, more particularly, to devices for reversing the direction of water flow.

2. Description of the Prior Art

Water hoses equipped with flow control nozzles are used for many purposes. For some applications, it is especially important to provide an adequate flow of water and to provide that flow of water to specific locations. When working with liquid concrete mixes, it is especially important to have an adequate water flow and to have appropriate directional control to put the water where it is needed before the concrete hardens. More specifically, in a ready mix concrete truck, the backsides of the fins of the ready mix drum are especially difficult to clean. Moreover, when the backsides of the fins are not cleaned properly, the concrete will harden and adhere to the fins. As a consequence, the use of a jackhammer may be required to remove hardened concrete buildup from the fins.

Presently, it is the practice of some workers to put their hands and arms into the mixing drum to remove the liquid concrete mixture off of the fins. Such a practice is fraught with danger of injury, and it would be desirable if such a practice could be avoided.

In using water to clean the backsides of the fins in the mixing drum, it is important that the flow of water be controllable. Without proper water flow control, the soft concrete that is cleaned off of the fins may splatter and cause an undesirable mess.

In order to properly clean the backsides of the fins contained in the concrete mixing drum, it would be desirable for a water flow to begin at the bottom edges of the fins and be directed upward toward the tops of the fins. Considering the fact that a worker must approach the mixing drum from the top, this is a very difficult task. In this respect, it would be desirable if a device were provided for cleaning the backsides of the fins contained in the concrete mixing drum that provided a water flow from the bottom edges of the fins toward the tops of the fins.

The bottom edges of the fins are below the opening of the mixing drum a predetermined distance, depending upon the depth of the drum. Therefore, it would be desirable if a device could be inserted into a mixing drum that predetermined distance from the top of the mixing drum and be used to adequately clean the backsides of the fins contained in the concrete mixing drum.

Throughout the years, a number of innovations have been developed relating to implements that use a water flow for cleaning, and the following U.S. patents are representative of some of those innovations: U.S. Pat. Nos. 4,930,706; 5,022,586; 5,058,612; and Des. 300,453. More specifically, U.S. Pat. No. 4,930,706 discloses a water broom that has a cleaning manifold oriented perpendicular to a water supply member. Such an arrangement is not suitable for fitting into narrow confines of a concrete mixer drum. In this respect, it would be desirable if a device were provided that provides a cleaning supply of water and that is narrow enough for fitting into the narrow confines of a concrete mixer drum.

U.S. Pat. No. 5,022,586 discloses a gutter cleaning device that uses water from a hose for cleaning roof gutters. A hand-held wand portion is oriented at right angles to a nozzle portion, and a wheel is provided for rolling the nozzle down the gutter. The right-angled orientation of the nozzle makes it impractical for fitting into the narrow confines of a concrete mixer drum. Moreover, the right-angled direction of water flow would not provide a water flow sufficient to clean the backsides of the fins contained in the concrete mixing drum.

U.S. Pat. No. 5,058,612 discloses a sprayer that has a spinner. For cleaning soft concrete mix off of the backsides of the fins contained in the concrete mixing drum, use of a spinner is not desirable because such use would result in uncontrolled splashing of the soft concrete mix.

U.S. Pat. No. Des. 300,453 discloses a hose-attached pressure sprayer that includes an attachment to an additive fluid dispenser. This device provides water flow and water spraying in one direction. Such unidirectional water flow is not suitable for adequately cleaning the backsides of the fins contained in the concrete mixing drum.

In addition, U.S. Pat. No. 4,850,728 may be of interest for its disclosure of a concrete truck delivery chute cleaning tool. This tool does not use water flow and would not be suitable for cleaning the backsides of the fins contained in the concrete mixing drum.

Thus, while the foregoing body of prior art indicates it to be well known to use hand-held implements that employ water flow for cleaning, the prior art described above does not teach or suggest a water wand apparatus which has the following combination of desirable features: (1) is capable of cleaning the backsides of the fins of a ready mix concrete drum; (2) is capable of washing soft concrete mix off of the fins before the concrete can harden and adhere to the fins; (3) precludes the need of a jackhammer to remove hardened concrete buildup from the fins; (4) precludes the unsafe practice of some workers to put their hands and arms into a mixing drum to remove the soft concrete mixture off of the fins; (5) provides controllable water flow; (6) provides a water flow directed from the bottom edges of the fins toward the tops of the fins; (7) can be inserted into a mixing drum for a predetermined distance that is present from the top of the mixing drum to the bottom edges of the mixing fins and can be used to adequately clean the backsides of the fins contained in the concrete mixing drum; (8) provides a water-supplying cleaning implement that is narrow enough for fitting into the narrow confines of a concrete mixer drum; and (9) does not use a spinner which would result in uncontrolled splashing of the soft concrete mix. The foregoing desired characteristics are provided by the unique water wand apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved water wand apparatus which includes a handle assembly which includes a tubular member. The tubular member is adapted for conducting water flow in a first direction from a source end to a nozzle end in the tubular member. A nozzle assembly is connected to the nozzle end of the tubular member. The nozzle assembly includes a nozzle-containing wall which includes a connection aperture for connecting to the tubular member. The nozzle-containing wall also includes a plurality of nozzle channels. The nozzle assembly also includes a truncated conical wall assembly connected to the nozzle-containing wall. The truncated conical wall assembly includes a wide end and a narrow end. An apex wall assembly is connected to the narrow end of the truncated conical wall assembly. The apex wall assembly serves to block water flow in the first direction, such that water pressure builds up within the nozzle assembly, and pressurized water exits from the nozzle channels in the nozzle-containing wall in a second direction.

The tubular member is substantially straight and is symmetrically disposed around a longitudinal axis. The nozzle assembly is symmetrically disposed around the longitudinal axis. The nozzle-containing wall includes a planar outer surface and is circular. A center of the circular nozzle-containing wall lies along the longitudinal axis, and the connection aperture is disposed symmetrically around the longitudinal axis. The planar outer surface of the nozzle-containing wall is juxtaposed to an orientation plane. The orientation plane is perpendicular to the longitudinal axis.

The nozzle channels are arrayed in a circular pattern on the nozzle-containing wall. The nozzle channels are arrayed symmetrically around the longitudinal axis. Each of the spray nozzles are at the same angle with respect to the longitudinal axis. The nozzle channels are oriented in the nozzle-containing wall where the same spray angle is in a range of spray angles ranging from zero to sixty degrees with respect to the longitudinal axis. The spray angle is preferably approximately thirty degrees.

The truncated conical wall assembly is arranged symmetrically around the longitudinal axis. Also, the apex wall assembly is arranged symmetrically around the longitudinal axis.

A manually-operated valve assembly is connected to the source end of the tubular member. The manually-operated valve assembly includes a threaded end adapted to be connected to a complementarily threaded hose. The manually-operated valve assembly includes a handle for controlling water flow through the manually-operated valve assembly, through the tubular member, through the nozzle assembly, and out the nozzle channels.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved water wand apparatus which has all of the advantages of the prior art and none of the disadvantages.

It is another object of the present invention to provide a new and improved water wand apparatus which may be easily and efficiently manufactured and marketed.

It is a further object of the present invention to provide a new and improved water wand apparatus which is of durable and reliable construction.

An even further object of the present invention is to provide a new and improved water wand apparatus which is susceptible of a low cost of manufacture with regard to both materials and labor, and which accordingly is then susceptible of low prices of sale to the consuming public, thereby making such water wand apparatus available to the buying public.

Still yet a further object of the present invention is to provide a new and improved water wand apparatus which is capable of cleaning the backsides of the fins of a ready mix concrete drum.

Still another object of the present invention is to provide a new and improved water wand apparatus that is capable of washing soft concrete mix off of the fins before the concrete can harden and adhere to the fins.

Yet another object of the present invention is to provide a new and improved water wand apparatus which precludes the need to a jackhammer to remove hardened concrete buildup from the fins.

Even another object of the present invention is to provide a new and improved water wand apparatus that precludes the unsafe practice of some workers to put their hands and arms into a mixing drum to remove the soft concrete mixture off of the fins.

Still a further object of the present invention is to provide a new and improved water wand apparatus which provides controllable water flow.

Yet another object of the present invention is to provide a new and improved water wand apparatus that provides a water flow directed from the bottom edges of the fins toward the tops of the fins.

Still another object of the present invention is to provide a new and improved water wand apparatus which can be inserted into a mixing drum for a predetermined distance that is present from the top of the mixing drum to the bottom edges of the mixing fins and can be used to adequately clean the backsides of the fins contained in the concrete mixing drum.

Yet another object of the present invention is to provide a new and improved water wand apparatus that provides a water-supplying cleaning implement that is narrow enough for fitting into the narrow confines of a concrete mixer drum.

Still a further object of the present invention is to provide a new and improved water wand apparatus that does not use a spinner which would result in uncontrolled splashing of the soft concrete mix.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figures 1, 2:
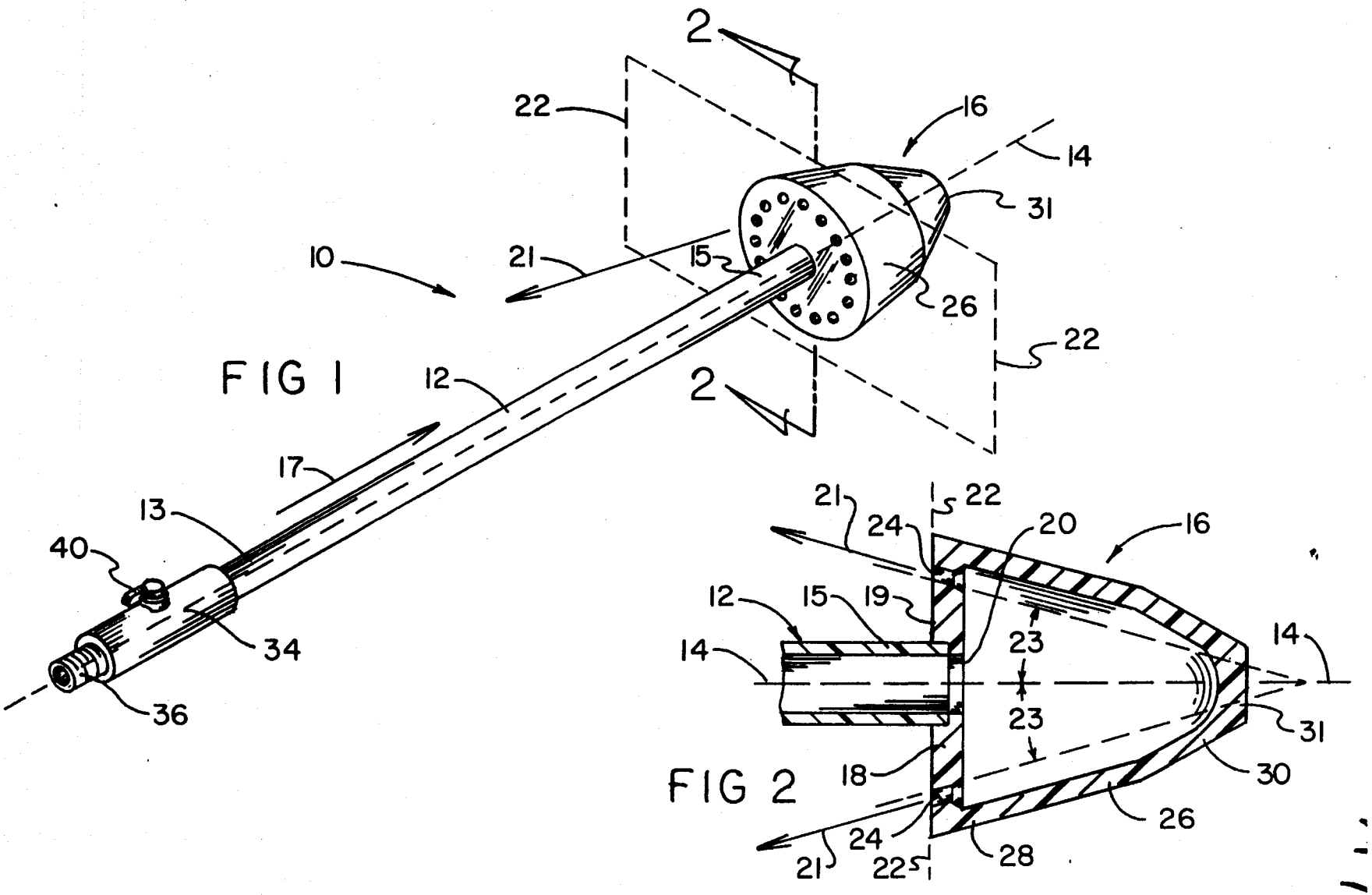
FIG. 1 is a perspective view showing a preferred embodiment of the water wand apparatus of the invention.
FIG. 2 is a cross-sectional view of the embodiment of the water wand apparatus shown in FIG. 1 taken along line 2—2 of FIG. 1.

With reference to the drawings, a new and improved water wand apparatus embodying the principles and concepts of the present invention will be described.

Turning to FIGS. 1 and 2, there is shown an exemplary embodiment of the water wand apparatus of the invention generally designated by reference numeral 10. In its preferred form, water wand apparatus 10 includes a handle assembly which includes a tubular member 12. The tubular member 12 is adapted for conducting water flow in a first direction 17 indicated by first directional arrow 17 from a source end 13 to a nozzle end 15 in the tubular member 12. A nozzle assembly 16 is connected to the nozzle end 15 of the tubular member 12. The nozzle assembly 16 includes a nozzle-containing wall 18 which includes a connection aperture 20 for connecting to the tubular member 12. The nozzle-containing wall 18 also includes a plurality of nozzle channels 24. The nozzle assembly 16 also includes a truncated conical wall assembly 26 connected to the nozzle-containing wall 18. The truncated conical wall assembly 26 includes a wide end 28 and a narrow end 30. An apex wall assembly 31 is connected to the narrow end 30 of the truncated conical wall assembly 26. The apex wall assembly 31 serves to block water flow in the first direction 17, such that water pressure builds up within the nozzle assembly 16, and pressurized water exits from the nozzle channels 24 in the nozzle-containing wall 18 in a second direction 21 indicated by second directional arrow 21.

The tubular member 12 is substantially straight and is symmetrically disposed around a longitudinal axis 14. The nozzle assembly 16 is symmetrically disposed around the longitudinal axis 14. The nozzle-containing wall 18 includes a planar outer surface 19 and is circular. A center of the circular nozzle-containing wall 18 lies along the longitudinal axis 14, and the connection aperture 20 is disposed symmetrically around the longitudinal axis 14. The planar outer surface 19 of the nozzle-containing wall 18 is juxtaposed to an orientation plane 22. The orientation plane 22 is perpendicular to the longitudinal axis 14.

The nozzle channels 24 are arrayed in a circular pattern on the nozzle-containing wall 18. The nozzle channels 24 are arrayed symmetrically around the longitudinal axis 14. As a result, water flowing in the second direction which is in the direction of the second directional arrow 21, flows in the form of a conical spray pattern out of the nozzle channels 24. The nozzle channels 24 are oriented in the nozzle-containing wall 18 in a range of spray angles 23 ranging from zero to sixty degrees with respect to a longitudinal axis 14. The spray angle 23 shown in FIG. 2 is approximately thirty degrees.

The truncated conical wall assembly 26 is arranged symmetrically around the longitudinal axis 14. Also, the apex wall assembly 31 is arranged symmetrically around the longitudinal axis 14. The nozzle end 15 of the tubular member 12 can be threaded for connection to a complementarily threaded connection aperture 20 in the wide end 28 of the nozzle-containing wall 18.

A manually-operated valve assembly 34 is connected to the source end 13 of the tubular member 12. The manually-operated valve assembly 34 includes and threaded end 36 adapted to be is connected to a complementarily threaded hose (not shown). The manually-operated valve assembly 34 includes a handle 40 for controlling water flow through the manually-operated valve assembly 34, through the tubular member 12, through the nozzle assembly 16, and out the nozzle channels 24. A source of water for supplying the water wand apparatus 10 of the invention can be a standard garden hose connected to an urban or suburban water supply.

The components of the water wand apparatus of the invention can be made from inexpensive and durable metal and plastic materials, such as half-inch diameter PVC materials commonly used in water containing pipes. A practical length for the water wand apparatus 10 is approximately 3 feet from the threaded end 36 of the manually-operated valve assembly 34 to the outside surface of the apex wall assembly 31 along the longitudinal axis 14. The manually-operated valve assembly 34 can be a readily available ball valve assembly.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved water wand apparatus that is low in cost, relatively simple in design and operation, and which may advantageously be used to clean the backsides of the fins of a ready mix concrete drum. With the invention, a water wand apparatus is provided which is capable of washing soft concrete mix off of the fins before the concrete can harden and adhere to the fins. With the invention, a water wand apparatus is provided which precludes the need to a jackhammer to remove hardened concrete buildup from the fins. With the invention, a water wand apparatus is provided which precludes the unsafe practice of some workers to put their hands and arms into a mixing drum to remove the soft concrete mixture off of the fins. With the invention, a water wand apparatus is provided which provides controllable water flow. With the invention, a water wand apparatus is provided which provides a water flow directed from the bottom edges of the fins toward the tops of the fins. With the invention, a water wand apparatus is provided which can be inserted into a mixing drum for a predetermined distance that is present from the top of the mixing drum to the bottom edges of the mixing fins and can be used to adequately clean the backsides of the fins contained in the concrete mixing drum. With the invention, a water wand apparatus is provided which provides a water-supplying cleaning implement that is narrow enough for fitting into the narrow confines of a concrete mixer drum. With the invention, a water wand apparatus is provided which does not use a spinner which would result in uncontrolled splashing of the soft concrete mix.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A water wand apparatus, comprising:

a handle assembly which includes a tubular member, said tubular member adapted for conducting water flow in a first direction from a source end to a nozzle end in said tubular member, a nozzle assembly connected to said nozzle end of said tubular member, said nozzle assembly including a nozzle-containing wall which includes a connection aperture for connecting to said tubular member, said nozzle-containing wall also including a plurality of nozzle channels, said nozzle assembly also including a truncated conical wall assembly connected to said nozzle-containing wall, said truncated conical wall assembly including a wide end forming a first trancated conical surface and a narrow end forming a second truncated conical surface, an apex wall assembly connected to said narrow end of said truncated conical wall assembly, said apex wall assembly serving to block water flow in said first direction, such that water pressure builds up within said nozzle assembly, and pressurized water exits from said nozzle channels in said nozzle-containing wall in a second direction, and a manually-operated valve assembly connected to said source end of said tubular member, wherein said tubular member is substantially straight and is symmetrically disposed around a longitudinal axis, wherein said nozzle assembly is symmetrically disposed around said longitudinal axis, wherein said nozzle-containing wall includes a planar outer surface and is circular, wherein a center of said circular nozzle-containing wall lies along said longitudinal axis, wherein said connection aperture is disposed symmetrically around said longitudinal axis, and wherein said planar outer surface of said nozzle-containing wall is juxtaposed to an orientation plane, wherein said orientation plane is perpendicular to said longitudinal axis, wherein said nozzle channels are arrayed in a circular pattern on said nozzle-containing wall, wherein said nozzle channels are arrayed symmetrically around said longitudinal axis, and wherein said truncated conical wall assembly is arranged symmetrically around said longitudinal axis with said first truncated conical surface decreasing in radial distance from said longitudinal axis in said first direction and forming a first cone angle with respect to said longitudinal axis, and said second truncated conical surface decreasing in radial distance from said longitudinal axis in said first direction and forming a second cone angle with respect to said longitudinal axis, said second cone angle being greater than said first cone angle, and wherein said apex wall assembly is arranged symmetrically around said longitudinal axis.

2. The apparatus described in claim 1 wherein each of said nozzle channels is oriented in said nozzle-containing wall at the same spray angle with respect to said longitudinal axis and wherein said same spray angle is in a range of spray angles ranging from zero to sixty degrees.

3. The apparatus described in claim 2 wherein said spray angle is approximately thirty degrees.

4. The apparatus described in claim 1 wherein said manually-operated valve assembly includes a threaded end adapted to be connected to a complementarily threaded hose.

5. The apparatus described in claim 1 wherein said manually-operated valve assembly includes a handle for controlling water flow through said manually-operated valve assembly, through said tubular member, through said nozzle assembly, and out said nozzle channels.

* * * * *